United States Patent [19]

Ikenishi

[11] Patent Number: 4,897,825

[45] Date of Patent: Jan. 30, 1990

[54] MAGNETIC SHIELDING STRUCTURE OF ANALOG ELECTRONIC TIMEPIECE

[75] Inventor: Masataka Ikenishi, Tokyo, Japan

[73] Assignee: Seiko Instruments Inc., Tokyo, Japan

[21] Appl. No.: 332,808

[22] Filed: Apr. 3, 1989

[30] Foreign Application Priority Data

Apr. 5, 1988 [JP] Japan ..... 63-46159[U]

[51] Int. Cl.[4] ..... G04B 19/04; G04B 37/00

[52] U.S. Cl. ..... 368/228; 368/293

[58] Field of Search ..... 368/88, 76, 223, 228, 368/276, 286, 293, 318

[56] References Cited

U.S. PATENT DOCUMENTS 4,033,111 7/1977 Matsuura ..... 368/293
4,236,240 11/1980 Yoshida ..... 368/29
4,243,329 1/1981 Nakayama ..... 368/85
4,317,188 2/1982 Ushikoshi ..... 368/293
4,496,246 1/1985 Ota et al. ..... 368/220

*Primary Examiner*—Vit W. Miska
*Attorney, Agent, or Firm*—Bruce L. Adams; Van C. Wilks

[57] ABSTRACT

An analog electronic timepiece for rotating hands by a motor through a wheel train has the structure that only an hour hand wheel is disposed between a main plate and a dial. The hand wheel is supported by a pin shaped projection of the main plate and a support plate fixed to the rear side of the main plate. A dial is also fixed to the rear side of the main plate through the support plate, or directly fixed to the support plate. The support plate is made of a material having a high magnetic permeability and extended to the both ends of a magnetic core of a motor assembly so that the timepiece is not easily affected by external magnetic disturbance.

7 Claims, 2 Drawing Sheets

MAGNETIC SHIELDING STRUCTURE OF ANALOG ELECTRONIC TIMEPIECE

BACKGROUND OF THE INVENTION

This invention relates to a magnetic shielding structure of an analog type electronic timepiece which drives hands through a hand wheel to indicate time, and more particularly relates to a structure integrating a magnetic shielding with an hour wheel supporting of an analog type electronic timepiece.

In conventional timepieces, there has a well known the structure of the magnetic shielding wherein a casing of an exterior is made of a material having a high magnetic permeability or such material is disposed as a separate member on the outer peripheral side of a coil block.

However, if a casing ring is composed of a magnetic screen, the casing ring becomes complicated in shape and becomes an expensive component. And if the magnetic screen is disposed outside the coil block, a movement becomes greater in size due to the thickness of the magnetic screen, and this renders the problem in that the timepiece cannot be made compact.

On the other hand, in timepieces having the structure wherein only an hour wheel is interposed between a main plate and a dial, an hour wheel friction spring made of a thin spring plate and an hour wheel seat, if necessary, are disposed on a shaft of the hour wheel between the hour wheel and the dial in order to secure and adjust vertical clearance of the hour wheel.

However, if the hour wheel friction spring and the hour wheel seat are disposed between the hour wheel and the dial, the force of the hour wheel friction spring for providing the vertical clearance of the hour wheel acts on the hour wheel and consequently, braking force is always applied to the hour wheel. This is one of the factors which reduces efficiency of the hand operation torque. Moreover, if the dial is removed for repair, at the time of repair the dial is usually detached for prevent a damage of the surface thereof , the hour wheel, the hour wheel friction spring and the hour wheel seat come also off and particularly because the hour wheel friction spring and the hour wheel seat are extremely small, they are often lost. If at least one of the hour wheel and the minute wheel is made of plastic material, the plastic component is often damaged when the hour wheel or the like is assembled again after the end of repair.

SUMMARY OF THE INVENTION

It is therefore an object of the invention to provide an analog timepiece which not only includes the magnetic screen between a main plate and a dial but also secures vertical clearance of the hour wheel by the magnetic screen so as to eliminate the increase of load to the hand operation torque, to stabilize vertical clearance of the hour wheel and to prevent loss and damage of components at the time of repair.

These and other objects of the invention are accomplished by an analog type electronic timepiece which comprises main plate, motor assembly provided on the front side of the main plate including a magnetic core, coil block wound on the magnetic core, a stator having one opening and a rotor in the opening, wheel train including a plurality of wheels provided on the front side of the main plate for transmitting rotation of the rotor to hands, hour hand wheel provided on the rear side of the main plate and driven by one of the wheels, hour wheel supporting plate fixed on the rear side of the base plate for supporting the hour wheel, the hour wheel supporting plate being made of a material having a high magnetic permeability and extended to the both ends of the magnetic core; and dial plate provided over the hour wheel supporting plate.

The hour wheel supporting plate may be made of a Ni-Fe alloy.

The front side of the base plate may have pin shaped projections and the magnetic core and stator may be fixed on the projection.

The rear side of said main plate may have pin shaped projections and the hour wheel supporting plate may have openings so as to be fixed to said main plate by inserting said projection into said opening.

The dial plate may be fixed to said main plate through said hour wheel supporting plate.

The dial plate may be fixed to said hour wheel supporting plate.

The rear side of said main plate may have a cylinder shaped projection and said hour hand wheel is supported by the outer surface of said projection and said hour wheel supporting plate.

According to the above structure, the changing factors of clearance of the hour wheel is reduced, the tilt of the hour wheel is made smaller and the hour wheel seat is removed, as a result, the vertical clearance of the hour wheel is stabilized, the increase of load acting on the hour wheel is eliminated. Furthermore, any adverse influences of external magnetism are efficiently prevented, as a result, an economical and compact timepiece which is highly resistant to an external magnetic field is obtained.

DETAILED DESCRIPTION OF THE PREFERRED EMBODIMENT

Hereinafter an embodiment of the present invention will be described with reference to the drawings.

Figure 1:
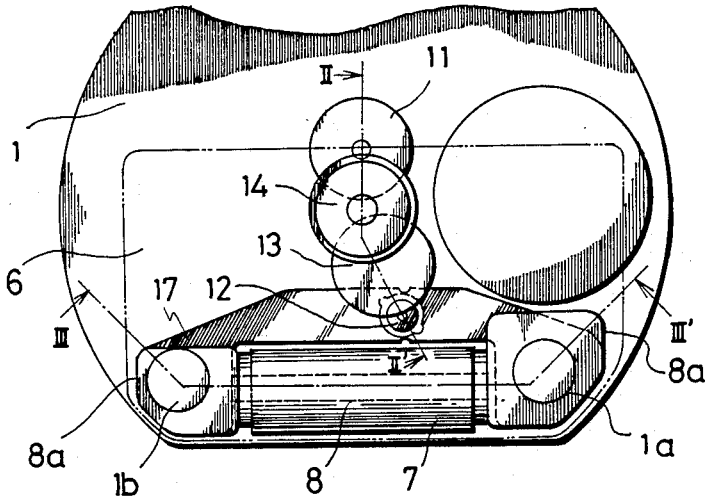
FIG. 1 is a plane view of the analog type electronic timepiece according to the present invention.

FIG. 1 shows a plane view of an electronic timepiece structure according to the present invention in the state of that a train wheel bridge is detached. Reference numeral 1 represents a main plate. On the main plate motor assembly is provided. The motor assembly is composed of a magnetic core 8, a coil block 7 wound on the magnetic core, stator plate having one opening and a rotor provided in the opening of the stator. The magnetic core and stator plate are fixed on the main plate by means of pins 1*a* and 1*b* disposed on the front side of the main plate. Train wheels 11, 12, 13 and 14 are provided on the front side of the main plate and transmit rotation of the rotor to hands. On the rear face of the main plate, a magnetic shield plate 6 made of a material having a high magnetic permeability is provided in such a manner as to extend to portions near both ends 8*a* of the magnetic core 8.

Figure 2:
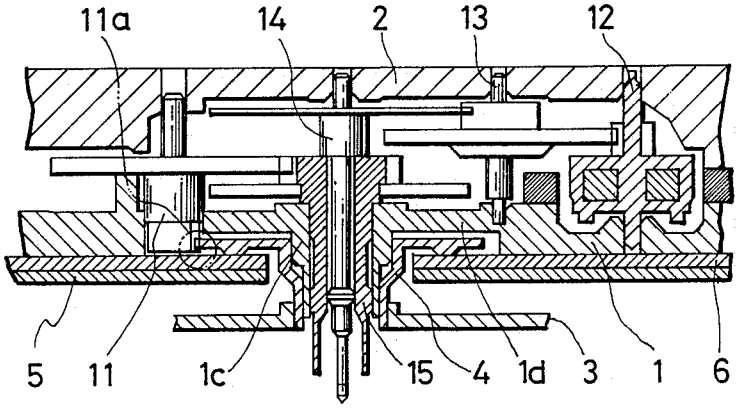
FIG. 2 is a sectional view taken along the lines 2—2 of FIG. 1.

FIG. 2 shows a sectional view taken substantially along the lines 2—2 of FIG. 1 with the train wheel bridge. Shaft holes for wheels 11,12,13 and 15 are bored on the main plate. Each shafts ends of wheels 11,12,13 and 15 is inserted in the shaft holes. A bore is drilled through the shaft of the wheel 15. The shaft of the wheel 14 is inserted into the bore of the shaft of the wheel 15. The Other side of the shaft of the wheel train 11,12,13 and 14 is supported at a shaft hole disposed on a train wheel bridge 2. The train wheel bridge 2 is fixed to the main plate through the pin 1*a* and 1*b* disposed on the former by suitable fastening means.

Figure 3:
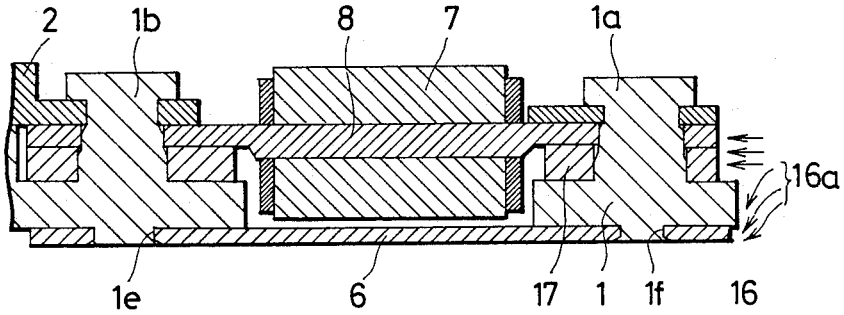
FIG. 3 is a sectional view taken along the lines 3—3 of FIG. 1.

As shown in FIG. 2, an hour wheel 4 to which an hour hand as part of the hands is disposed on the back of the main plate 1. The main plate 1 has a circular projection 1*c* at the shaft holes of the wheel 15 to a dial. The projection of the main plate is inserted into a cylinder shaft of the hour wheel so that transversal shake of the hour wheel 4 is guided by the outer periphery of the circular projection 1*c* disposed on the main plate 1 and vertical clearance is provided between the thinner portion 1*d* of the main plate 1 and a magnetic shield screen 6. A dial 5 is provided over the magnetic shield screen 6. The dial 5 may fixed on the magnetic shield plate directly or on the base plate 1 through the magnetic shield plate. The magnetic shield plate 6 is fixed to the rear face of the main plate 1 through pins 1*e* and 1*f* disposed on the back of the main plate as shown in FIG. 3. The magnetic screen 6 is disposed in such a manner as to extend not only to the support portion of the hour wheel 4 but also to portions near both end surfaces 8*a* of the magnetic core 8 so that the external magnetic field 16 is shielded by the magnetic shielding plate 6 without permitting it to pass only through the magnetic core 8 and stator 17. A magnetic shielding effect can thus be obtained to the extent corresponding to the passage of the external magnetic field through the magnetic shield plate 6.

Moreover, since the hour wheel 4 is supported by the magnetic shield plate and the shield plate is fixed to the main plate, even when the dial is removed for repairing, the hour wheel 4 is yet supported to the movement and there is no necessity for the hour wheel to reassemble, therefore gear portions 4*a* and 11*a* of the hour wheel and minute wheel 11 are not damaged by reassembling.

As described above, in the wheel train structure of the hand type electronic timepiece of the hand type electronic timepiece of the type wherein all the wheels other than the hour wheel are supported rotatably on the front side of the main plate, the present device forms the hour wheel support plate by a material having a high magnetic permeability (or plated by a high permeability plating) and disposes it plane-wise up to the portions near both end surfaces of the magnetic core in order to stabilize vertical clearance of the hour wheel and to accomplish a high magnetic shielding structure. In this manner, the present device makes it possible to stabilize vertical clearance of the hour wheel, to omit the hour hand seat, etc, and to eliminate the increase of load applied to the hour wheel. Since the coil block and the hour wheel support (magnetic shield plate) are superposed, it is not necessary to dispose the magnetic screen outside the coil block and it becomes possible to accomplish simultaneously miniaturization and reduction of the cost of production of the timepiece.

What is claimed is:

1. An analog electronic timepiece comprising;

a main plate;

a motor assembly provided on the front side of said main plate including a magnetic core, coil block wound on said magnetic core, a stator having one opening and a rotor in said opening;

a wheel train including a plurality of wheels provided on the front side of said main plate for transmitting rotation of said rotor to hands;

an hour hand wheel provided on the rear side of said main plate and driven by one of said wheels;

an hour wheel supporting plate fixed on said rear side of said main plate for supporting said hour wheel;

said hour wheel supporting plate being made of a material having a high magnetic permeability and extended to the both ends of said magnetic core; and a dial plate provided over said hour wheel supporting plate.

2. The analog electronic timepiece as claimed in claim 1 wherein said hour wheel supporting plate is made of a Ni-Fe alloy.

3. The analog electronic timepiece as claimed in claim 1 wherein said front side of said main plate has pin shaped projections and said magnetic core and stator are fixed on said projection.

4. The analog electronic timepiece as claimed in claim 1 wherein said rear side of said main plate has pin shaped projections and said hour wheel supporting plate has openings so as to be fixed to said main plate by inserting said projection into said opening.

5. The analog electronic timepiece as claimed in claim 1 wherein said dial plate is fixed to said main plate through said hour wheel supporting plate.

6. The analog electronic timepiece as claimed in claim 1 wherein said dial plate is fixed to said hour wheel supporting plate.

7. The analog electronic timepiece as claimed in claim 1 wherein the rear side of said main plate has a cylinder shaped projection and said hour hand wheel is supported by the outer surface of said projection and said hour wheel supporting plate.

* * * * *